United States Patent [19]

Neumüller

[11] Patent Number: 4,636,004

[45] Date of Patent: Jan. 13, 1987

[54] SEAT MOUNTING FOR CHAIRS, IN PARTICULAR SWIVEL-TYPE DESK CHAIRS

[76] Inventor: Konrad Neumüller, Gibitzenhof-Street 21, D-8501 Burgthann, Fed. Rep. of Germany

[21] Appl. No.: 640,437

[22] Filed: Aug. 13, 1984

[30] Foreign Application Priority Data

Aug. 12, 1983 [EP] European Pat. Off. ..... 83108004.9

[51] Int. Cl.[4] ..... A47C 1/027

[52] U.S. Cl. ..... 297/374; 74/99 A; 297/306; 297/313; 297/344

[58] Field of Search ..... 297/298, 304, 306, 313, 297/344, 363, 364, 374, 375; 74/99 A; 188/166; 403/46, 160, 341, 380

[56] References Cited

U.S. PATENT DOCUMENTS

| | | | |
|---|---|---|---|
| 1,265,104 | 5/1918 | Ogden | 403/46 |
| 3,735,843 | 5/1973 | Wüg | 188/166 X |
| 3,974,712 | 8/1976 | Kaufman et al. | 74/99 A X |
| 4,062,587 | 12/1977 | Wolters | 297/374 X |
| 4,198,094 | 4/1980 | Bjerknes et al. | 297/306 |
| 4,270,906 | 6/1981 | Kraft et al. | 74/99 A X |
| 4,438,978 | 3/1984 | Arild | 297/304 |

FOREIGN PATENT DOCUMENTS

| | | | |
|---|---|---|---|
| 2836606 | 3/1979 | Fed. Rep. of Germany | 297/313 |
| 8100044 | 1/1981 | World Int. Prop. O. | 297/376 |
| 401718 | 11/1933 | United Kingdom | 297/374 |

*Primary Examiner*—Francis K. Zugel
*Assistant Examiner*—Peter R. Brown
*Attorney, Agent, or Firm*—Peter K. Kontler

[57] ABSTRACT

A seat mounting for a swivel chair has a channel shaped base member connected to the base of the chair, a T-shaped seat supporting element having a channel shaped bearing member and an angular second member and being pivotable relative to the base member, height and pitch adjusting devices on the base member, and a clamp which is pivotally attached to the base member and supports a backrest.

8 Claims, 7 Drawing Figures

Figure 1:
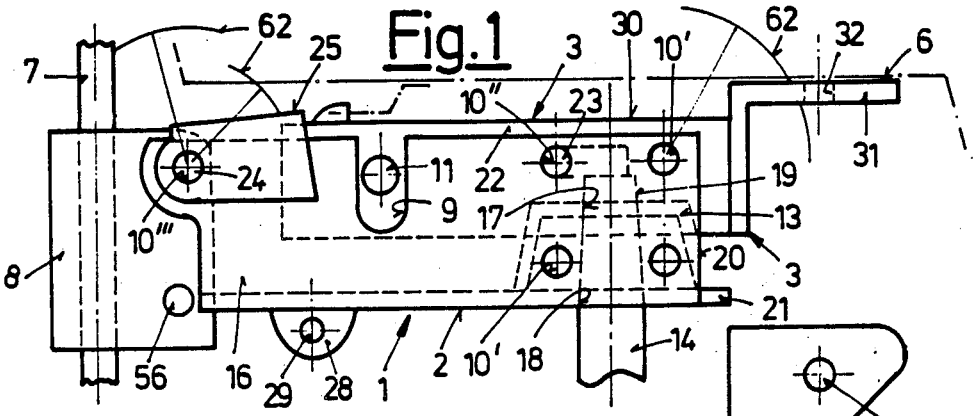

7
62
25
3
30
10'
62
32
6
10''
23
24
11
22
19
31
9
17
13
10'''
20
3
8
21
56
16
29
28
1
2
10'
18
14

12
23
12'
56
12'''
25
59
61
15
36
10'
8
24
30
34
60
21
7
22
9
35
16
11
37
12
2
10

10'''
29
15
12

26
25
17
18
13
14
21
2
29
28
16
9

31
2
3
38
7
4
36

8
55
56
39
37
5
11

SEAT MOUNTING FOR CHAIRS, IN PARTICULAR SWIVEL-TYPE DESK CHAIRS

The invention relates to a seat mounting for chairs, especially swivel-type desk chairs, which can be connected to a base of the chair by means of a post (column) and for the purpose of this connection with the post is fitted with a bracket which accommodates in particularly force-closed fashion the cantilevered end of the post, wherein the seat mounting comprises a channel-shaped basic member in which this bracket is inserted so that it cannot be dislocated, and this seat mounting is also equipped with support elements to carry a seat resting on top of it, as well as the seat which on its support elements is capable of adjusting its angular position in relation to the basic member, and this basic member is provided with a series of functioning parts on the one hand for its height adjustment and on the other for the pitch adjustment of the seat, and wherein the moving parts, with exception of the manually operated parts actuating them, are arranged in between the flanks of the channel-shaped basic member.

On a known seat mounting for the same type of seating furniture (DE-Gm No. 72 39 551) the seat and back rest are connected to a support structure by fastening means, this connection being made so that the pitch angle of the seat as well as of the back rest can be adjusted and these adjusted positions can be locked. In this case, the means for holding the seat are made in the form of straps of which one end is hinge-connected to the seat mounting while the other end is guided in a locking device. The locking device essentially consists of friction plates, which are arranged with the straps and which are spaced some distance from each other, as well as of a pressure element, which presses the friction plates against one another, and is attached to the support structure in such a way that the straps move between the friction plates and can be locked there. This more or less deep movement of the straps through the clearance spaces between the friction plates enables the pitch angle of the seat to be varied accordingly, the angular position of the seat itself being secured by tightening the friction plates to the straps. Similar to tightening the angular position of the seat it is also possible to adjust the fastening means of the back rest and lock it in the adjusted position. For this purpose the support arm of the back rest is guided axially in a clamp head, this clamp head being hinge-connected to the support structure or seat mounting. The support arm can be tightened at the clamp head by means of a pressure element which acts on the same locking device. Since with this design the locking device simultaneously serves to lock the support arm and with it the clamp head as well, it is possible to change and secure the pitch angle of the seat and back rest together by actuating the pressure element. This is frequently considered a convenience in so far as one single motion made by a seated person permits adjustment of the pitch angle of the seat as well as of the back rest. With this known design, however, it is regarded as a disadvantage that the lamination packs for the seat and back rest extend far beyond the seat mounting and thereby on occasions give cause for injuries.

Another seat mounting for seating furniture of this type (DE-Gm No. 78 25 224) is essentially formed by an oval stirrup which encompasses a tilting and locking mechanism. The stirrup, one end of which is mounted in a shaft, houses a tilting element which is mounted on the same shaft so that it can tilt and is provided with a force-closed connection, i.e. a bracket, for a post for the seating furniture. A forked support arm is connected to this bracket whereby lamination packs are provided in the area of the support arm tenons for the purpose of seat angle adjustment as well as for back rest angle adjustment. These lamination packs are clamped between the tenons and another shaft and are locked force-closed by a pressure element which can be actuated manually by means of a release lever. In this case the laminations for the back rest adjustment are held between the tenons of the support arm while the laminations for the seat angle adjustment are secured around the other shaft in the area of the clamp head of the back rest yoke. The lamination packs for the seat as well as back rest angle adjustments engage in one another and are held together by means of a common clamping member, this clamping member itself being held in the locking mechanism. For the actuation of this locking mechanism a manually operated release lever is provided which is guided on the seat mounting by a spring keeping it in a position of readiness and which is held there under spring tension.

The release lever, extensively of cylindrical design, is flattened at its free extending end facing the pressure element, this flat area resting level on a pressure plate when the release lever is in normal position. Moving the release lever causes this flat area to lift off the base plate and locks or releases the lamination pack according to the subsequently resulting change in space. In the process, the degree of locking the lamination pack is determined solely by a screw of the clamping member which depending on its penetration in the pressure plate ensures a more or less strong locking of the laminations. However, even with this seat mounting it cannot be ruled out that the lamination packs and their peripheral parts could be a source of injury and that in particular tilting moments cannot be absorbed with this clamping feature because the bracket on the support element may be the cause of deformations. Added to this is the fact that such deformation possibilities can impair the friction connection of the laminations whereupon it might be necessary to constantly readjust the seat angle or back rest angle.

It is the object of the present invention to form a seat mounting such that its locking elements for the seat and/or back rest angle adjustment are not only accommodated beyond the possible reach of the person seated but also ensures a separation of the support of the seat mounting and the functioning means of the seat or back rest angle adjustment.

This object is achieved according to the invention in having a seat mounting of the type mentioned above wherein the (a) the support element is tee-shaped and is formed by a channel-shaped bearing member and an angular member, (b) the bearing member is inserted between the upward pointing flanks of the channel-shaped basic member and is mounted with its flanks on the flanks of the basic member so that it can tilt, (c) the tilt axis of the support element is envisaged in the area of the free end of the basic member, (d) a clamping element is inserted between the flanks of the bearing member, this clamping element being made up of a spring-loaded bracket with manually-actuated release lever and at least two pressure plates which are arranged at a distance from one another, as well as longitudinal and transverse lamination packs which are inserted between the pressure plates, (e) the longitudinal lamination pack is supported at the one end at the mounting pins of the clamping element and at the other end at least at one mounting pin of the clamp head, (f) the transverse lamination pack is supported at the one end at the mounting pins of the clamping element and at the other end at a mounting pin of the basic member, (g) the bracket has a groove-shaped indentation between the mounting pins, fixing the bracket to the bearing member, and it is this indentation which houses the free end of the release lever, which is cranked to form an angle.

As a result of these measures a seat mounting is created which in addition to the functional separation of the support and adjustment features unifies all necessary moving parts in itself and essentially keeps them out of reach from outside. This design enables the moving parts for seat and back rest adjustment to be made extremely compact and gives them the special advantage that as a result of their functional separation from one another they are not negatively influenced by one another. Another advantage of the moving parts of the seat angle adjustment and back rest adjustment can be seen in that the interacting lamination packs are held by a constant forceclosed connection and that this force-closed connection can only be released when an adjustment appears necessary. The embodiment of the lamination packs, i.e. the longitudinal and transverse packs, is made in form and enclosure to also ensure tilting safety against torsion so that even rocking of the seat hardly makes it possible for the force-closed connection to disconnect. The clamping element for the force-closed connection of the individual lamination packs can be made of very compact design and still have sufficient stiffness to exert a high surface pressure onto the individual lamination packs by means of its adjacent pressure plates. By mounting the lamination packs on the pins also holding the bracket these packs are fixed in their position with sufficient accuracy so that they can only be moved inside one another like scissors without impairing their fastening.

Other advantageous embodiments of the invention can be gathered especially from the remaining subclaims.

Figure 2:
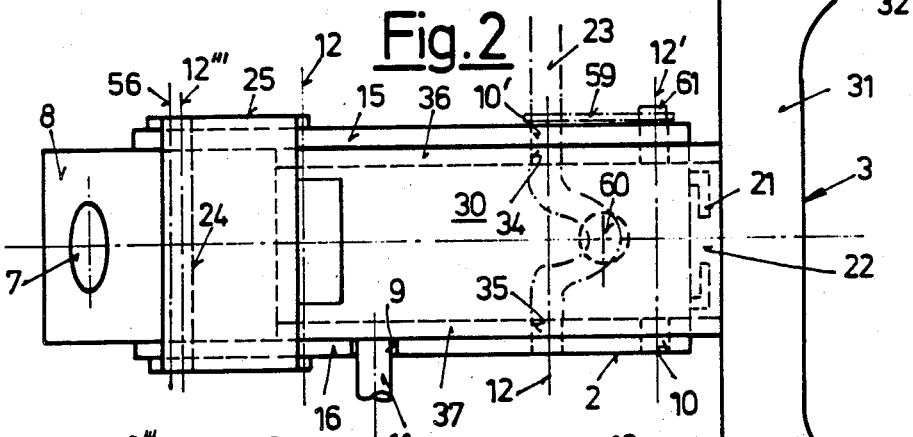
Figure 3:
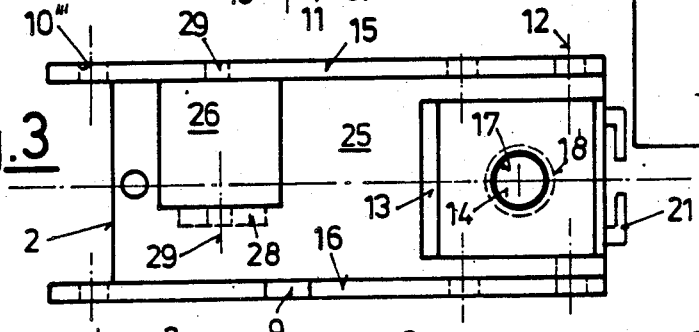
Figure 4:
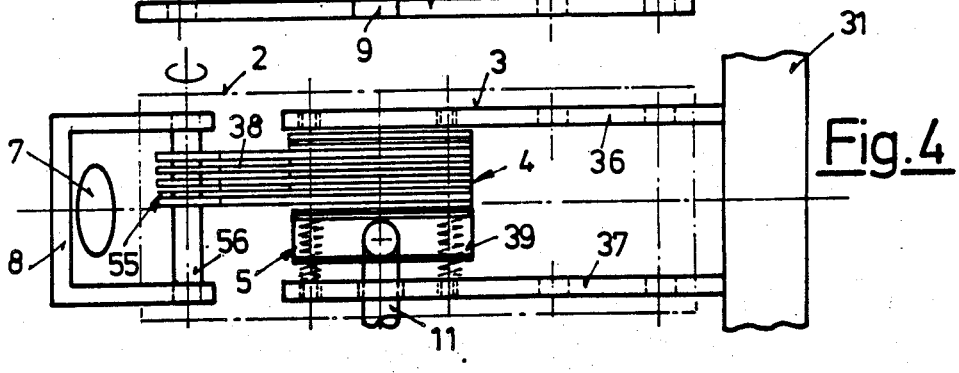
Figure 5:
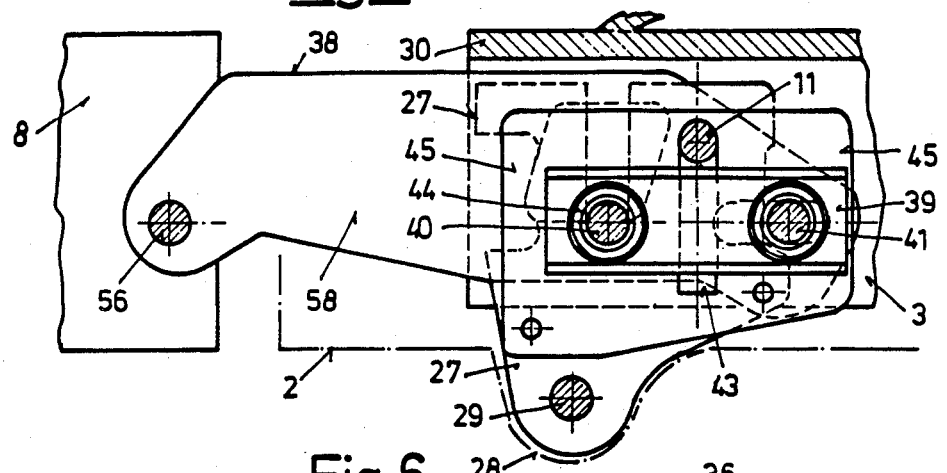
Figure 6:
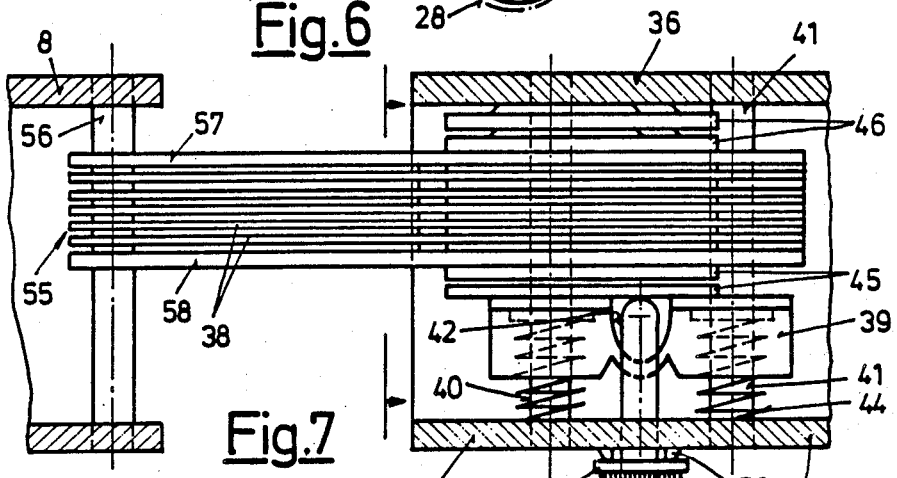
Figure 7:
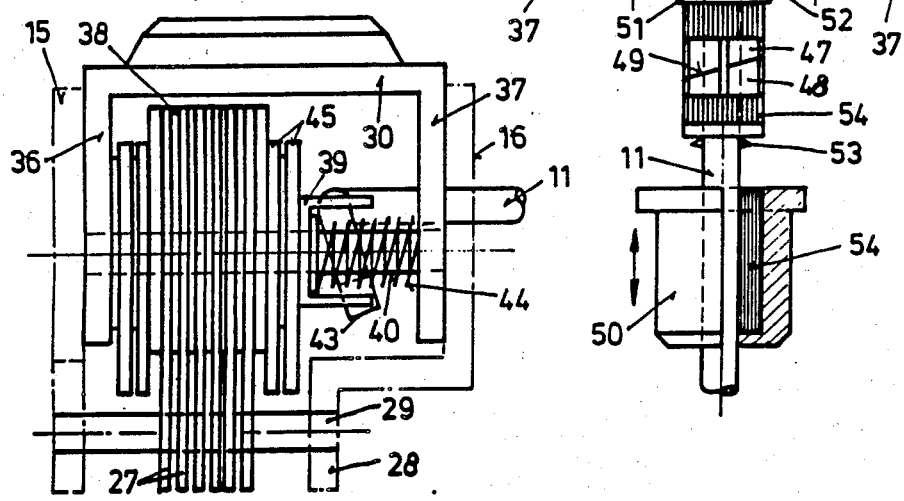

One of the possible embodiment of the design is illustrated schematically in the drawing. It shows:

FIG. 1 a side view of the seat mounting in ready-to-operate version with a superimposed seat which is, however, only indicated by a dot-dash line, FIG. 2 a plan view of the seat mounting as in FIG. 1, FIG. 3 a plan view of the basic member with bearing member and clamp head removed, FIG. 4 a plan view of the bearing member and clamp head plus lamination packs, but with covering piece of the bearing member cut out in the area of the lamination packs and with a basic member indicated only by a dot-dash line, FIG. 5 enlarged side view of the lamination packs, but with one of the flanks of the channel-shaped bearing member removed and showing only part of the clamp head, FIG. 6 a plan view of the bearing member and the clamp head as in FIG. 5, where the release lever for the clamping element is pivot-mounted on the bearing member, and this release lever is shown with the parts for its longitudinal locking and a cover sleeve about to be pushed over the interlocking bushings, in which case half of the covering sleeve is illustrated in section and FIG. 7 a section of the longitudinal lamination pack and the clamping element looking in the direction of the section arrows in FIG. 6.

According to the invention the seat mounting 1 is essentially formed by a basic member 2, a bearing member 3, a clamping element 4 in addition to locking feature 5 for the pitch angle of a seat 6 and a back rest which is pivot-mounted on a yoke piece 7 and which is not shown in the drawing, the back rest yoke being axially guided in a clamp head 8. The seat mounting 1 and thus its basic member 2 consists of a channel-shaped plate which is provided with a series of cutouts 9 and holes 10 for the penetration and mounting of levers 11 and shafts 12 as well as with a bracket 13 for the form-closed connection of the post 14 of the seat. While the holes 10 and cutouts 9 are essentially provided on the channel-shaped flanks 15, 16 of the basic member 2, the bracket 13 is arranged in the area of one end of this basic member and is formed by a plate which has a hole 17. Coaxial to this hole 17 there is another hole 18 of differing diameter intended for the free end of the post which has a taper 19. In the area of the free end 20 of the basic member 2 and thus in the vicinity of this bracket 13 the basic member incorporates clasp-like shapings which serve to additionally secure the bracket to this basic member. At this same end 20 of the basic member 2 there are holes 10 in the vicinity of the bracket on the flanks 15, 16 of the channel-shaped basic member, of which the one hole 10' provided at the corner of the flank is for the penetration of the swivel axis 12' of a bearing member 22 to be connected with the basic member 2 and one hole 10'' adjacent to the first is provided for inserting the release lever 23 for actuation of a lifting mechanism for post 14 of the seat. Approximately in the middle of the basic member 2 one of its flanks 16 has a U-shaped cutout 9 for passage of the release lever 11 of the locking mechanism. Likewise the flanks 15, 16 of the channel-shaped basic member 2 have various hole 10''' at their ends facing the bracket 13, of which two end holes are intended for the passage of a mounting shaft 12''' for the clamp head 8 while the holes 10 adjacent to these holes 10''' are for the passage of another swivel shaft 24 for a cap 25. Similar to these arrangements for various passages 9, 10 there are on the middle web 25 of the channel-shaped basic menber 2 other cutouts 26, of which one approximately rectangular cutout serves for the insertion of several laminations 27 of a transverse lamination pack and mounts 28 are attached on this basic element 2 for a hinge pin 29 for the articulation of this lamination pack.

The bearing member 22, which acts functionally with the basic member 2, is preferably made in the form of a tee with its one part 30 made from a channel-shaped plate element and its other part 31 from another angular-shaped plate element. Preferably both parts 30, 31 should be permanently joined by means of welding and the angular-shaped part 31 should be provided with cutouts 32 for fastening it to the seat 6 to be supported. The channel-shaped part 30, i.e. the channel-shaped section of the bearing member 22, should also be provided with holes 10 in the area of its angular plate for the passage of pivot shafts 12 and/or the release lever 23, the pivot shaft being provided directly in the vicinity of the angle-shaped part 31 and the other cutouts 34, 35 for the release lever 23 being made along the flanks 36, 37 of the channel-shaped bearing member 22. In the area of the free extending end of the bearing member 22 the locking mechanism 4, 5 is provided for the angular adjustment of the seat 6 and back rest, i.e. yoke 7, and essentially comprises the two lamination packs 27, 38 and the locking element 5 which act on these packs in a force-closed fashion. The lamination packs 27, 38 are formed by a longitudinal lamination pack 38 and a lamination pack arranged transverse to it. Their laminations are held by the individual lamination teeth and force-closed against one another by means of the clamping pressure of the locking element 5. The locking element 5 itself comprises a bracket 39 which is secured by hinge pins 40, 41, which are again mounted in flanks 36, 37 of the channel-shaped bearing member 22, and which bracket 39 incorporates an indentation 42 between its fixing points on the mounting pins for the free end 43 of the release lever 11. The indentation 42 for this free end 43 is made in the form of a groove, and around the mounting pins 40, 41 there are compression springs 44 which support themselves by spring action between the one flank 37 of the bearing member 22 and the bracket 39. Pressure plates 45, 46 are provided beteen the bracket 39 and the longitudinal lamination pack 38 on the one hand and this pack and the other flank 36 of the channel-shaped bearing member 22 on the other, these pressure plates also guiding the mounting pins 40, 41 and being secured by these pins on the channelshaped bearing member 22. The bracket 39 acts on one of these pressure plates in a force-closed fashion, and it is only possible to lift this bracket from the pressure plate when force is applied at the release lever 11 which acts against the pressure of springs 44. The release lever 11, the free end of which 43 is angular in shape, is secured with its angular section in the indentation 42, and this end is supported by the outer edge of the channel-shaped flank 37 of the bearing member 22 in such a manner that when the release lever 11 is actuated this lever pulls the bracket 39 in the direction of the flank 37 so as in this manner to lift the bracket from its pressure plate 45. In order to let the release lever 11 act on this bracket 39 in the process a length compensating feature is provided on the release lever which is formed by bushings 47, 48 with conical contact surfaces 49 and a cover sleeve 50 which locks one of these bushings. Between the bushings 47 and 48 themselves and the channel-shaped flank 37 of the bearing member 22 there is a clearance space which is preferably created by a metallic washer 51 and projections 52 of flank 37. In order to prevent a longitudinal displacement of the bushings 47, 48 on the release lever 11 the lever is provided with lugs 53 which support the bushings after their longitudinal spacing has been set. The cover sleeve 50 as well as the bushings 47, 48 themselves are provided with longitudinal grooves 54 which after setting the longitudinal distance intermesh as a form-closed connection and prevent the bushings from turning backwards on their conical contact surfaces 49.

The locking device 4, 5 itself, which houses the longitudinal lamination pack 38 and the transverse lamination pack 27, is mounted as well as guided by these packs on both the bearing member 22 and the mounting pins 40, 41, 29 and 56, whereby one end of this longitudinal lamination pack 38 is hinge-mounted on the one mounting pin 41 and the adjacent section of this lamination pack guided in a sliding fashion on the mounting pin 40. The transverse lamination pack 27 which is roughly triangular in shape is secured with its one point in the bearing member 2 and here going around the mounting pin 29 which is housed in eye 28 of the bearing member, as well as at the other mounting pins 40, 41. The longitudinal lamination pack 38, which again with its one end is swivel-mounted on one of the mounting pins 41 and is guided in sliding fashion on the adjacent mounting pin 40, is mounted with its other free end 55 around a mounting pin 56 of the clamp head 8 in such a manner that the same actuation of the locking device 5 makes it possible to change the pitch angle of the seat 6 as well as the pitch angle of the back rest or yoke 7.

In the example illustrated and described here it is possible to move the bearing member 22 around its pivot point 10' on the basic member 2 according to the change in the locking device 4, 5 around its pivot point which enables adjustment of the individual positions ofthe seat 6 and/or the back rest, i.e. yoke 7. In order to have a sufficient friction connection between the individual lamination packs 27, 38 it is recommendable to make the laminations quite thin so as in this manner to fit a large number of laminations within the flanks 36, 37 of bearing member 22.

For better support of lamination packs 27, 38, and here in particular longitudinal lamination pack 38 and its enclosure, this pack can be held laterally by thick outer plates 57, 58 which also adequately support this lamination pack against torsion. The force-closed locking of the lamination packs 27, 38 by means of clamping element 4,5 is made possible by the compression-loaded springs 44 which force with sufficient strength the bracket 39 against the lamination packs. The locking springs 44 are placed concentrically around the mounting pins 40, 41 and allow themselves with little effort to compress only upon exertion of the lever action of the release lever 11.

In cases, for example, in which a gas spring is provided as a post 14 for the seating mounting 1 between that mounting and a base stand not shown in the drawing, and this gas spring is known to contain a release mechanism, an angular-shaped lever 23 can be pivot-mounted (in order to actuate that mechanism) in the bearing member 2 in such a manner that this lever is held under the tension of a spring 59 in a position just before release of the gas spring. To release the gas spring it is therefore necessary to move this lever 23 against the pressure of the spring 59 tensioning it, thereby pressing a throw 60 provided on this lever against the release pin of the gas spring and keeping it pressed in until the desired height of post 14 has been attained. The lever 23 itself for releasing the gas spring is therefore not held in this so-called resting position by the pressure of the gas spring but by the action of the spring 59 which tensions the lever and is supported on the one hand by that release lever 23 and on the other hand by a mounting pin 61 on bearing member 2.

The shape of the triangular and longitudinal laminations 27, 38 of the individual lamination packs is shown in FIGS. 5 and 6, whereby it is not ruled out that other lamination shapes can be used.

In those cases where no importance is placed on the simultaneous adjustment of the back rest with the adjustment of seat 6 the longitudinal lamination pack 38 can be suitably disconnected so that transverse lamination pack 27 and thus its laminations and intermediate plates are retained and can then be held in closed and resting positions by the same clamping element 4, 5. In the embodiment illustrated here, however, it is possible to tilt the bearing member at its hinge connection 10' against the basic member as is also indicated by the tilting chords 62 for bearing member 22 as well as yoke 7 and cap 25.

I claim:

1. In a seat mounting for chairs, especially swivel-type desk chairs, which can be connected to the base of a chair by a post and comprises a bracket which accommodates a cantilevered end of the post, the seat mounting having a channel-shaped base member including a free end, a mounting pin and upwardly pointing flanks in which the bracket is fixedly installed, the seat mounting further having a supporting element for a seat whose angular position with reference to the base member is adjustable and the base member being provided with height adjusting means and pitch adjusting means having moving parts between the flanks of the base member and manually operated parts outside of the base member, the improvement which consists in that the supporting element is tee-shaped and includes a channel-shaped bearing member and an angular second member, the bearing member having flanks disposed between the flanks of said base member and said supporting element being pivotable relative to said base member about an axis adjacent to the free end of said base member, said base member further including a clamp pivotally attached at it other end for supporting a backrest therein, said clamp having a mounting pin thereon spaced from the pivotal attachment, said bearing member provided with a clamping device having pins and which is disposed between the flanks of the bearing member, said clamping device comprising a spring-loaded bracket member with a manually actuatable crankshaped release lever having a free end and at least two pressure plates which are spaced apart from each other as well as longitudinal and transverse lamination packs between the pressure plates for adjustment of the angular position of the backrest supporting clamp and the height and pitch of the bearing member respectively, the longitudinal lamination pack having holes for the pins of said clamping device at one of its ends and being attached to the mounting pin of said clamp at the other end thereof, the holes for the pins of the clamping device being of sufficient size to allow relative shifting movement between the longitudinal lamination pack and the bearing member, said transverse lamination pack having a first end slidably mounted on the pins of said clamping device and a second end mounted on the pin of said base member, said bracket member having a recessed portion disposed between the pins of said clamping device, connecting said bracket member to said bearing member and receiving the free end of said release lever, and in the provision of springs for biasing said bracket member toward said packs, said springs being mounted on the pins of said clamping device.

2. The seat mounting of claim 1, wherein said packs have positions of rest and said bracket member is force-lockingly connected with said packs via the pressure plates when said packs assume the positions of rest.

3. The seat mounting of claim 1, wherein said release lever is provided with length compensating means.

4. The seat mounting of claim 3, wherein said length compensating means comprises two bushings which can be tightened against each other and a sleeve which can be pushed over said bushings to establish a form-locking connection.

5. The seat mounting of claim 4 wherein, in order to axially tighten the bushings, the opposed ends of the bushings are provided with contact surfaces which tighten the lever in response to turning of such surfaces.

6. The seat mounting of claim 5, wherein said release lever comprises stops for said bushings and said bushings are disposed between the stops.

7. The seat mounting of claim 1, wherein said transverse lamination pack has triangular laminations with corners mounted on the pins of said clamping device and said base member.

8. The seat mounting of claim 1, wherein said base member surrounds at least three different sides of said bearing member.

* * * * *